US008622029B2

(12) United States Patent
Maryamchik et al.

(10) Patent No.: US 8,622,029 B2
(45) Date of Patent: Jan. 7, 2014

(54) CIRCULATING FLUIDIZED BED (CFB) WITH IN-FURNACE SECONDARY AIR NOZZLES

(75) Inventors: Mikhail Maryamchik, Fairlawn, OH (US); Kiplin C. Alexander, Wadsworth, OH (US); Mark C. Godden, Mogadore, OH (US); David L. Kraft, Massillon, OH (US)

(73) Assignee: Babcock & Wilcox Power Generation Group, Inc., Barberton, OH (US)

( * ) Notice: Subject to any disclaimer, the term of this patent is extended or adjusted under 35 U.S.C. 154(b) by 1134 days.

(21) Appl. No.: 12/571,279

(22) Filed: Sep. 30, 2009

(65) Prior Publication Data

US 2011/0073050 A1 Mar. 31, 2011

(51) Int. Cl.
*F23C 10/00* (2006.01)

(52) U.S. Cl.
USPC ..... 122/4 D; 165/104.16; 110/245

(58) Field of Classification Search
None
See application file for complete search history.

(56) References Cited

U.S. PATENT DOCUMENTS

| | | | | | |
|---|---|---|---|---|---|
| 4,665,864 | A * | 5/1987 | Seshamani et al. | ..... | 122/4 D |
| 5,239,946 | A * | 8/1993 | Garcia-Mallol | ..... | 122/4 D |
| 5,313,913 | A * | 5/1994 | Ohshita et al. | ..... | 122/4 D |
| 5,678,497 | A * | 10/1997 | Goidich | ..... | 110/245 |
| 5,836,257 | A * | 11/1998 | Belin et al. | ..... | 110/245 |
| 6,500,221 | B2 * | 12/2002 | Walker et al. | ..... | 55/444 |
| 6,532,905 | B2 * | 3/2003 | Belin et al. | ..... | 122/4 D |
| 6,631,698 | B1 * | 10/2003 | Hyppanen et al. | ..... | 122/4 D |
| 6,709,636 | B1 * | 3/2004 | Oshita et al. | ..... | 422/146 |

* cited by examiner

*Primary Examiner* — Steven B McAllister
*Assistant Examiner* — John Bargero
(74) *Attorney, Agent, or Firm* — Eric Marich

(57) ABSTRACT

A circulating fluidized bed (CFB) boiler includes a reaction chamber, where a bubbling fluidized bed (BFB) is contained within an enclosure within the lower portion of the reaction chamber and contains an in-bed heat exchanger (IBHX) that occupies part of the reaction chamber floor. A plurality of in-bed secondary air nozzles comprise a plurality of tubes which are grouped together and run across the width of the BFB between the BFB enclosure wall and an outside wall of the CFB. The nozzles are positioned to prevent the deflection of solids falling onto the BFB from the CFB by the secondary air jets while avoiding a complicated structure that would interfere with gas and/or solids movement in the furnace. The nozzles' exit openings are flush, or almost flush, with the BFB enclosure wall.

7 Claims, 3 Drawing Sheets

FIG. 4
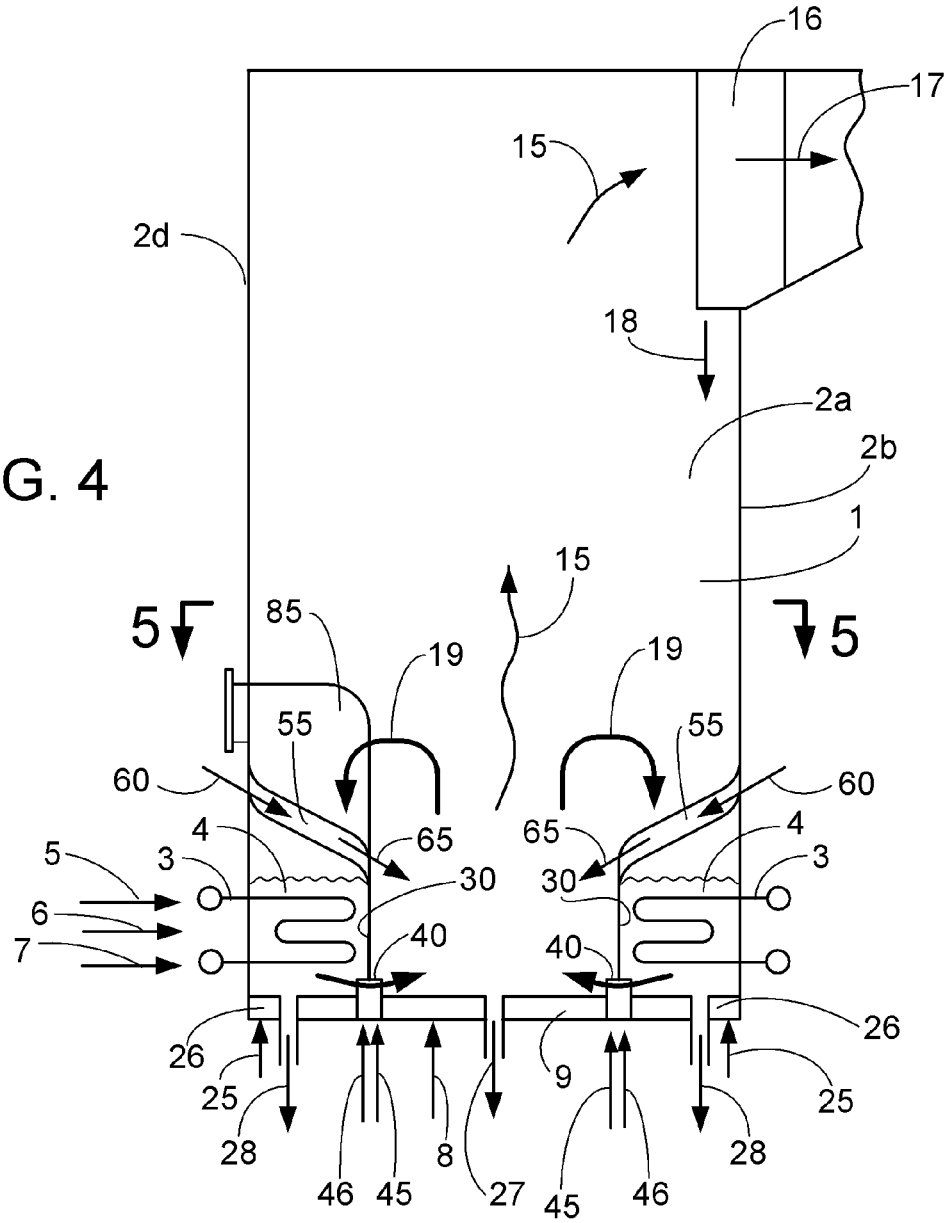
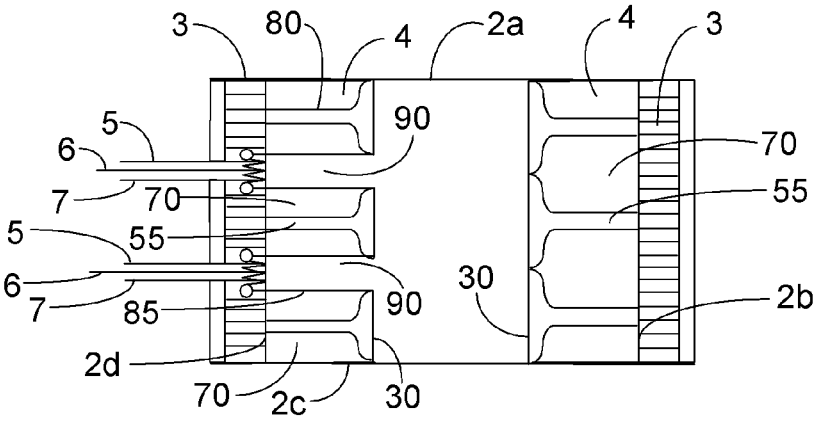
FIG. 5

CIRCULATING FLUIDIZED BED (CFB) WITH IN-FURNACE SECONDARY AIR NOZZLES

FIELD AND BACKGROUND OF THE INVENTION

1. Field of the Invention

The present invention relates generally to the field of circulating fluidized bed (CFB) reactors or boilers such as those used in industrial or electric power generation facilities and, in particular, to in-furnace secondary air nozzles designed to prevent deflection of solids falling onto a bubbling fluidized bed (BFB) from the CFB by secondary air jets.

2. Description of the Related Art

U.S. Pat. No. 6,532,905 to Belin et al. describes a CFB boiler with controllable in-bed heat exchanger (IBHX). The boiler comprises a CFB reaction chamber as well as a BFB heat exchanger located inside the reaction chamber. Heat transfer in the heat exchanger is controlled by means of controlling the rate of solids discharge from the lower part of the BFB into the reaction chamber. The overall heat transfer capacity of the IBHX depends on the solids downflow on the top of the bubbling bed in the IBHX from the CFB furnace. A higher downflow rate results in a higher heat transfer capacity. Secondary air is typically supplied to a CFB furnace via nozzles located at the front and rear furnace walls. The nozzles are located outside the furnace enclosure and their exit openings are flush with those walls. Because the IBHX is located adjacent to the wall(s) containing the nozzles, jets from the nozzles will deflect part of the solids downflow from the IBHX thus reducing its heat transfer capacity.

U.S. Pat. No. 5,836,257 to Belin et al. describes a CFB furnace with an integral secondary air plenum. Such a plenum allows placing secondary air nozzles inside the furnace thus preventing interference of their jets with the solids downflow to the IBHX. However, the supporting structure and/or air supply means of the plenum may interfere with the gas and/or solids movement in the furnace, and accommodating nozzles of the size sufficient to allow adequate jet penetration into a large CFB requires plenum which is larger than desirable.

SUMMARY OF THE INVENTION

The present invention prevents deflection of the solids falling onto the BFB from the CFB by secondary air jets while avoiding a complicated structure that would interfere with the gas and/or solids movement in the furnace.

Accordingly, one aspect of the present invention is drawn to a circulating fluidized bed (CFB) boiler comprising: a CFB reaction chamber having side walls and a grid defining a floor at a lower end of the CFB reaction chamber for providing fluidizing gas into the CFB reaction chamber; a bubbling fluidized bed (BFB) located within a lower portion of the CFB reaction chamber and being bound by outer wall(s) of the CFB reaction chamber, the floor of the CFB reaction chamber and enclosure wall(s) formed by cooled tubes that extend upward from the floor of the CFB to the height of the BFB; at least one controllable in-bed heat exchanger (IBHX), the IBHX comprising a heating surface and occupying part of the CFB reaction chamber floor and being surrounded by the enclosure walls of the BFB; and at least one in-furnace secondary air nozzle formed by the cooled tubes of the BFB enclosure wall that are formed into at least one group that extends from the top of the BFB enclosure wall across the width of the BFB until reaching the outer wall of the CFB.

The tubes forming the at least one in-furnace secondary air nozzle may become part of the outer wall when they reach the outer wall of the CFB. Additionally, the exit opening of the least one in-furnace secondary air nozzle is flush, or almost flush, with the enclosure wall of the BFB.

The various features of novelty which characterize the invention are pointed out with particularity in the claims annexed to and forming part of this disclosure. For a better understanding of the invention, its operating advantages and specific benefits attained by its uses, reference is made to the accompanying drawings and descriptive matter in which exemplary embodiments of the invention are illustrated.

BRIEF DESCRIPTION OF THE DRAWINGS

FIG. 4 is a sectional side elevational view of a CFB boiler according to another embodiment of the invention; and FIG. 5 is a sectional plan view of the CFB boiler of FIG. 4, viewed in the direction of arrows 5-5 of FIG. 4.

DESCRIPTION OF THE INVENTION

The present invention relates generally to the field of circulating fluidized bed (CFB) reactors or boilers such as those used in industrial or electric power generation facilities and, in particular, to in-furnace secondary air nozzles designed to prevent the deflection of solids falling into the BFB from the CFB by secondary air jets.

As used herein, the term CFB boiler will be used to refer to CFB reactors or combustors wherein a combustion process takes place. While the present invention is directed particularly to boilers or steam generators which employ CFB combustors as the means by which the heat is produced, it is understood that the present invention can readily be employed in a different kind of CFB reactor. For example, the invention could be applied in a reactor that is employed for chemical reactions other than a combustion process, or where a gas/solids mixture from a combustion process occurring elsewhere is provided to the reactor for further processing.

Figure 1:
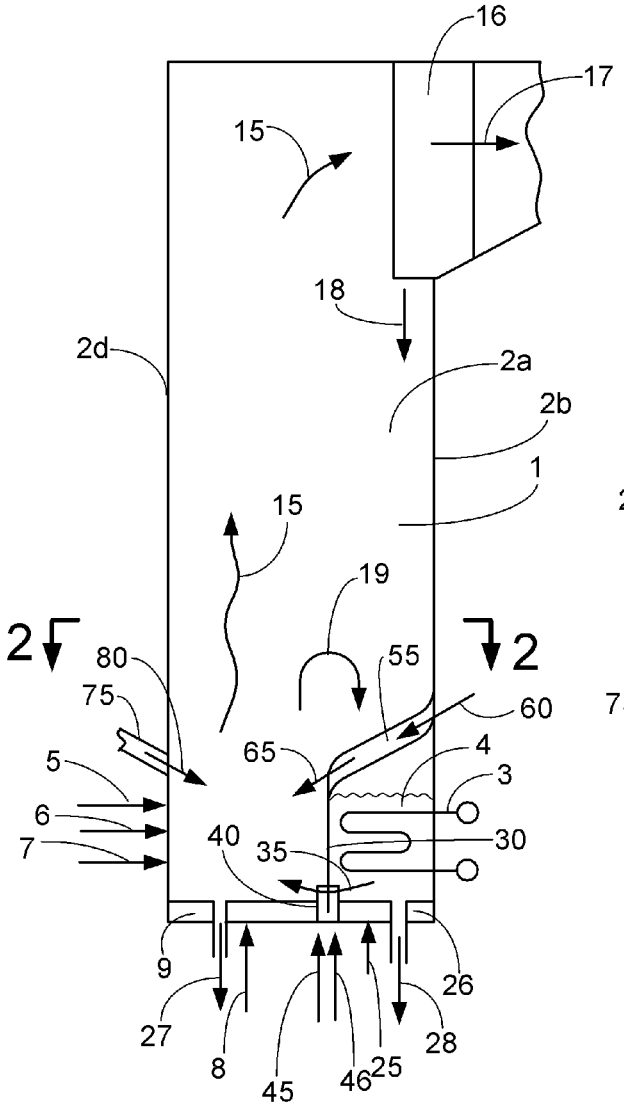
FIG. 1 is a sectional side elevational view of a CFB boiler according to the invention illustrating the secondary air nozzles.
Figure 2:
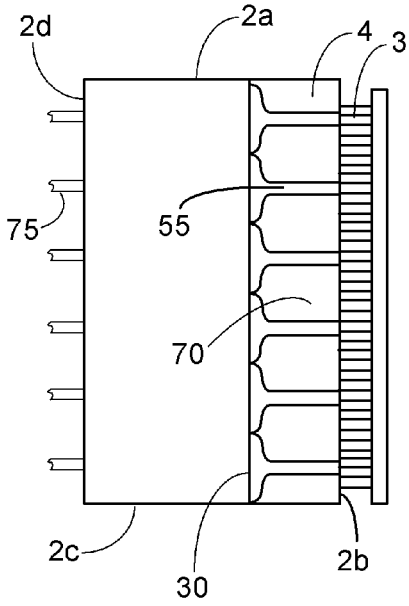
FIG. 2 is a sectional plan view of the CFB boiler of FIG. 1, viewed in the direction of arrows 2-2 of FIG. 1.

Referring now to the drawings, wherein like reference numerals designate the same or functionally similar elements throughout the several drawings and to FIG. 1 in particular, a sectional side elevational view of a CFB furnace 1 is shown comprising walls 2 and an IBHX 3 immersed in a BFB 4. The CFB is predominantly comprised of solids made up of the ash from the combustion of the fuel 5, sulfated sorbent 6 and, in some cases, external inert material 7 fed through at least one of the walls 2 and fluidized by the primary air 8 supplied through a distribution grid 9. Some solids are entrained by gases resulting from the fuel combustion and move upward 15 eventually reaching a particle separator 16 at the furnace exit. While some of the solids 17 pass the separator, the bulk of them 18 are captured and recycled back to the furnace. Those solids along with others 19, falling out of the upflow solids stream 15, feed the BFB 4 that is being fluidized by the fluidizing medium 25 fed through a distribution grid 26. Means for removing solids from CFB and BFB (27 and 28 respectively) are provided in the pertinent areas of the furnace floor.

The BFB is separated from the CFB by an enclosure 30. Rate of solids recycle 35 back to the CFB through a valve 40 is controlled by controlling streams of fluidizing medium 45 and 46. The enclosure is made of tubes 50 that are typically cooled by water or steam. The tubes are usually protected from the erosion and/or corrosion by a protective layer, commonly formed by a refractory held by studs welded to the tubes. The tubes forming the enclosure extend upward to the elevation allowing the required BFB 4 height within the CFB furnace 1. Above the required height, the tubes 50 group into forming secondary air nozzles 55. Air 60 fed to these nozzles is injected into the CFB beyond the BFB 4, thus its jets 65 do not deflect streams of solids 18 and 19 from falling onto the BFB 4. Grouping the tubes 50 allows forming the openings 70 through which the solids streams 18 and 19 fall onto the BFB 4. After reaching the wall 2*b*, the tubes 50 can become part of this wall. Secondary air nozzles 75 on the opposite wall 2*d* are located externally to the CFB furnace 1. Since no IBHX is placed below the nozzles 75, their jets 80 do not cause any undesired effect.

Figure 3:
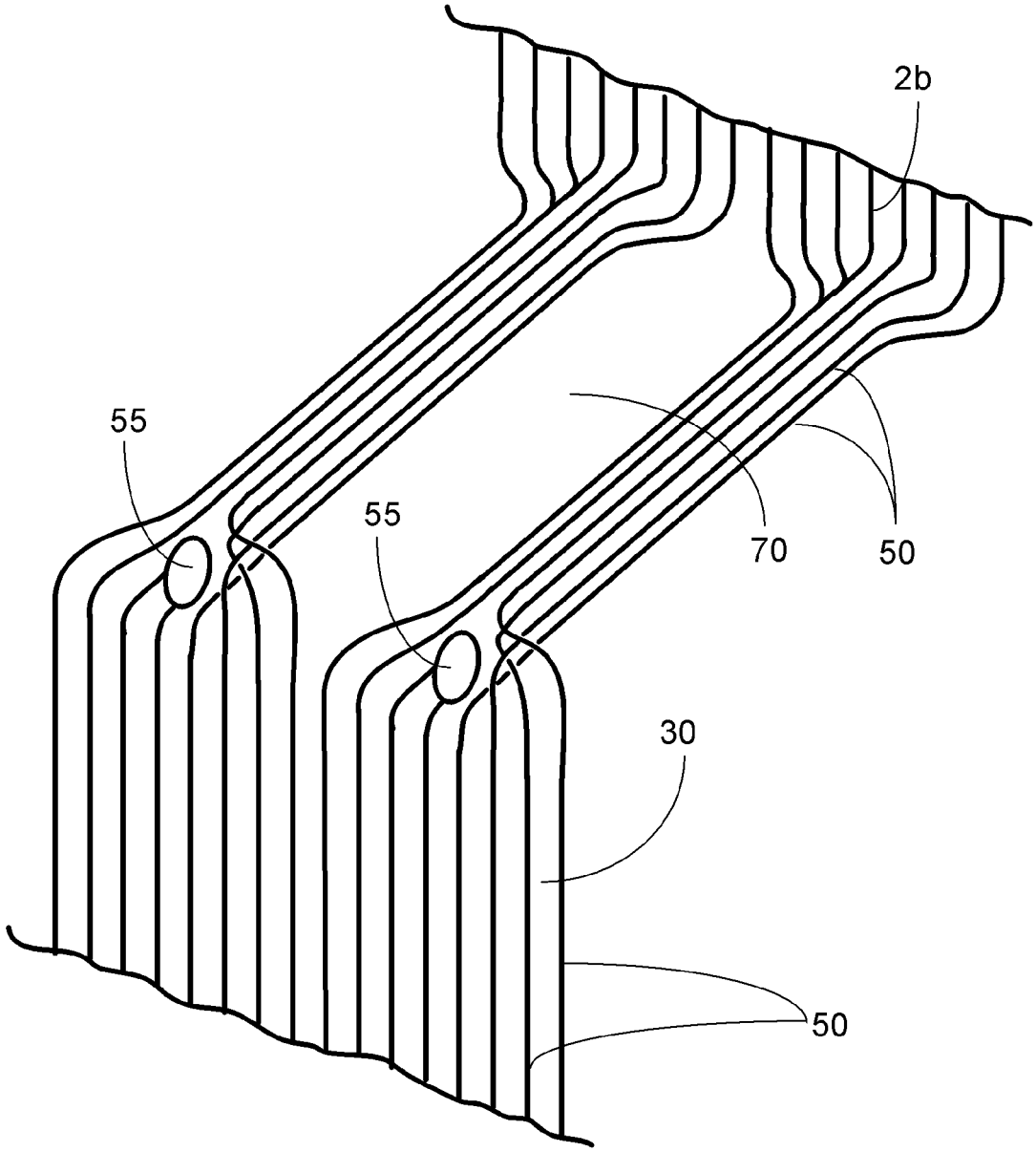
FIG. 3 is a schematic perspective view of the BFB enclosure, where tubes forming the in-furnace secondary air nozzles are represented as single lines.

FIG. 3 illustrates one possible construction of the in-furnace secondary air nozzles 55 formed by tubes 50. In FIG. 3, the tubes 50 forming the in-furnace secondary air nozzles 55 are schematically represented as single lines.

In an alternative embodiment, illustrated in FIGS. 4 and 5, BFB 4 with immersed IBHX 3 is located on both of opposite furnace walls 2*b* and 2*d*. Tubes 50 of enclosure 30 on both sides of the furnace group to form secondary air nozzles 55. In order to feed fuel, limestone and other solids streams directly into the CFB, the BFB on at least one furnace wall (the 2*d* wall in this embodiment of FIGS. 4 and 5) is broken into several compartments 80. Each compartment 80 is formed by a furnace wall 2*d*, enclosure 30 and two side walls 85 (or one side wall 85 and a furnace wall 2*a* or 2*c*). The compartments are separated from each other by gaps 90 where the fuel, limestone, etc. is fed.

While specific embodiments of the present invention have been shown and described in detail to illustrate the application and principles of the invention, it will be understood that it is not intended that the present invention be limited thereto and that the invention may be embodied otherwise without departing from such principles. In some embodiments of the invention, certain features of the invention may sometimes be used to advantage without a corresponding use of the other features. Accordingly, all such changes and embodiments properly fall within the scope of the following claims.

What is claimed is:

1. A circulating fluidized bed (CFB) boiler comprising:

a CFB reaction chamber having side walls and a grid defining a floor at a lower end of the CFB reaction chamber for providing fluidizing gas into the CFB reaction chamber;

a bubbling fluidized bed (BFB) located within a lower portion of the CFB reaction chamber and being bound by one or more of the side walls of the CFB reaction chamber, the floor of the CFB reaction chamber, and an enclosure wall formed by cooled tubes that extend upward from the floor of the CFB to a height of the BFB; at least one controllable in-bed heat exchanger (IBHX) immersed in the BFB, the IBHX comprising a heating surface and occupying part of the CFB reaction chamber floor; and at least one in-furnace secondary air conduit and nozzle defined by a plurality of the cooled tubes of the BFB enclosure wall, wherein the cooled tubes further extend from a top of the BFB enclosure wall across the width of the BFB to one of the side walls of the CFB reaction chamber, and wherein the plurality of the cooled tubes forms openings through which solids can fall into the BFB.

2. The CFB boiler according to claim 1, wherein when the tubes forming the at least one in-furnace secondary air nozzle reach the one side wall of the CFB, the tubes become part of the one side wall.

3. The CFB boiler according to claim 1, wherein the exit opening of the least one in-furnace secondary air nozzle is flush, or almost flush, with the enclosure wall of the BFB.

4. The CFB boiler according to claim 1, wherein the tubes comprising the BFB enclosure wall are covered with a protective layer.

5. The CFB boiler according to claim 4, wherein the protective layer is formed by a refractory held by studs welded to the tubes.

6. The CFB boiler according to claim 1, wherein the tubes forming the in-furnace secondary air nozzles are covered with a protective layer.

7. The CFB boiler according to claim 6, wherein the protective layer is formed by a refractory held by studs welded to the tubes.

* * * * *